US008843022B2

(12) United States Patent
Sato et al.

(10) Patent No.: US 8,843,022 B2
(45) Date of Patent: Sep. 23, 2014

(54) IMAGE FORMING APPARATUS

(75) Inventors: Shougo Sato, Seto (JP); Hiroshi Nakano, Nagoya (JP); Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 334 days.

(21) Appl. No.: 13/349,606
(22) Filed: Jan. 13, 2012
(65) Prior Publication Data

US 2012/0183319 A1 Jul. 19, 2012

(30) Foreign Application Priority Data

Jan. 14, 2011 (JP) ..... 2011-005933

(51) Int. Cl.
*G03G 15/00* (2006.01)
*G03G 21/18* (2006.01)

(52) U.S. Cl.
CPC .... *G03G 21/1853* (2013.01); *G03G 2215/0141* (2013.01)
USPC ..... 399/110; 399/117

(58) Field of Classification Search
USPC ..... 399/110, 111, 113, 114, 116, 117, 125
See application file for complete search history.

(56) References Cited

U.S. PATENT DOCUMENTS

| | | | | |
|---|---|---|---|---|
| 7,720,411 | B2 | 5/2010 | Itabashi | |
| 7,778,567 | B2 | 8/2010 | Igarashi et al. | |
| 7,991,325 | B2 | 8/2011 | Yamaguchi | |
| 8,078,085 | B2 | 12/2011 | Okabe | |
| 8,150,294 | B2 | 4/2012 | Okabe et al. | |
| 8,238,786 | B2 | 8/2012 | Yamaguchi et al. | |
| 8,311,437 | B2 | 11/2012 | Sato | |
| 2003/0053819 | A1 | 3/2003 | Nomura et al. | |
| 2006/0067734 | A1 | 3/2006 | Igarashi et al. | |
| 2006/0251446 | A1* | 11/2006 | Okabe et al. | 399/110 |
| 2007/0077087 | A1 | 4/2007 | Okabe et al. | |
| 2008/0219696 | A1 | 9/2008 | Itabashi | |
| 2009/0087209 | A1 | 4/2009 | Yamaguchi | |
| 2009/0142092 | A1 | 6/2009 | Sato | |
| 2009/0190953 | A1 | 7/2009 | Okabe | |
| 2009/0190955 | A1 | 7/2009 | Igarashi et al. | |
| 2009/0269101 | A1* | 10/2009 | Okabe et al. | 399/114 |
| 2010/0080614 | A1 | 4/2010 | Yamaguchi et al. | |
| 2011/0293324 | A1 | 12/2011 | Hoashi | |
| 2012/0189346 | A1 | 7/2012 | Okabe et al. | |
| 2013/0004201 | A1 | 1/2013 | Sato | |

FOREIGN PATENT DOCUMENTS

| | | | |
|---|---|---|---|
| JP | 04-212973 | A | 8/1992 |
| JP | 08-036346 | | 2/1996 |
| JP | 2003-043776 | | 2/2003 |
| JP | 2006-098772 | | 4/2006 |
| JP | 2007-101635 | | 4/2007 |
| JP | 2008-224837 | | 9/2008 |
| JP | 2009-080394 | A | 4/2009 |
| JP | 2009-139495 | | 6/2009 |
| JP | 2009-157135 | | 7/2009 |
| JP | 2009-175416 | | 8/2009 |
| JP | 2009-265442 | A | 11/2009 |
| JP | 2010-102355 | A | 5/2010 |
| JP | 2010-244018 | A | 10/2010 |
| JP | 2010256920 | A | 11/2010 |

OTHER PUBLICATIONS

JP Decision of Grant for Patent dtd Jan. 29, 2013, JP Appln. 2011-005933, English translation.

* cited by examiner

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

In an image forming apparatus, a drum supporting member has a pair of opposed sidewalls facing in an axial direction of a plurality of photoconductor drums, and supports the plurality of photoconductor drums at insides of the sidewalls. A sheet output tray portion is formed in an upper wall of a casing of the apparatus as a downwardly recessed portion to receive a recording sheet with an image formed thereon. Part of the drum supporting member is disposed in spaces formed inside the casing at both sides of the sheet output tray portion facing in the axial direction of the plurality of photoconductor drums. The part of the drum supporting member overlaps the sheet output tray portion as viewed in the axial direction.

13 Claims, 7 Drawing Sheets

IMAGE FORMING APPARATUS

CROSS-REFERENCE TO RELATED APPLICATION(S)

This application claims priority from Japanese Patent Application No. 2011-005933 filed on Jan. 14, 2011, the disclosure of which is incorporated herein by reference in its entirety.

FIELD

Apparatuses consistent with one or more aspects of the present invention relate to an image forming apparatus including a sheet output tray portion provided in an upper wall of a casing and configured to place a sheet ejected from the casing onto the sheet output tray portion.

BACKGROUND

An image forming apparatus of a particular type known in the art includes a drum supporting member configured to support a plurality of photoconductor drums and removably installed in a casing of the apparatus, a scanner configured to emit a laser beam directed to the plurality of photoconductor drums to expose each photoconductor drum to the laser beam, and a sheet output tray portion configured to receive a sheet being ejected with an image formed thereon by the plurality of photoconductor drums and other components of the apparatus. To be more specific, the sheet output tray portion in this type of the image forming apparatus is configured to include a first wall and a second wall wherein the first wall extends from an upper wall of the casing of the apparatus in a downward direction perpendicular to the upper wall, and the second wall extends obliquely upward, gently curing so as to upwardly bulge like an arc as viewed in cross section, from a lower end of the first wall toward the upper wall of the casing of the apparatus. The first wall has an ejection port formed therein for a sheet to be ejected therethrough.

Also in this type of the image forming apparatus, a scanner is disposed in a space under the upwardly bulging second wall (i.e., under the sheet output tray portion), and the drum supporting member is disposed below the bottom of the sheet output tray portion (i.e., below the lower end of the first wall).

SUMMARY

A new technology using an LED head in place of a scanner has been developed in recent years. The LED head is smaller than the scanner and disposed in proximity to a photoconductor drum, and thus the aforementioned space under the sheet output tray portion would become a wasted space. To address this problem, if the casing of the apparatus is designed to have a lower profile by positioning the upper wall closer to the bottom of the sheet output tray portion (i.e., the lower end of the first wall), the aforementioned space is reduced and the apparatus can be miniaturized. In this configuration, however, the sheet output tray portion would disadvantageously become shallower.

It is one aspect of the present invention to provide an image forming apparatus in which a casing is miniaturized in its vertical dimension while a sheet output tray has a depth maintained as desired.

More specifically, according to one or more embodiments of the present invention, an image forming apparatus is provided which comprises a casing, a plurality of photoconductor drums, and a drum supporting member. The casing has an upper wall in which a sheet output tray portion is formed as a downwardly recessed portion to receive a recording sheet with an image formed thereon. The drum supporting member has a pair of opposed sidewalls located in positions corresponding to opposite ends facing in an axial direction of the plurality of photoconductor drums. The drum supporting member is configured to support the plurality of photoconductor drums at insides of the sidewalls, and to be movable through an opening provided in the casing between a first position in which the drum supporting member is located inside the casing and a second position in which the drum supporting member is located outside the casing. Part of the drum supporting member is disposed in spaces formed inside the casing at both sides of the sheet output tray portion facing in the axial direction of the plurality of photoconductor drums, such that the part of the drum supporting member overlaps the sheet output tray portion as viewed in the axial direction.

BRIEF DESCRIPTION OF THE DRAWINGS

The above aspect, its advantages and further features of the present invention will become more apparent by describing in detail illustrative, non-limiting embodiments thereof with reference to the accompanying drawings, in which.

DESCRIPTION OF EMBODIMENTS

Figure 1:
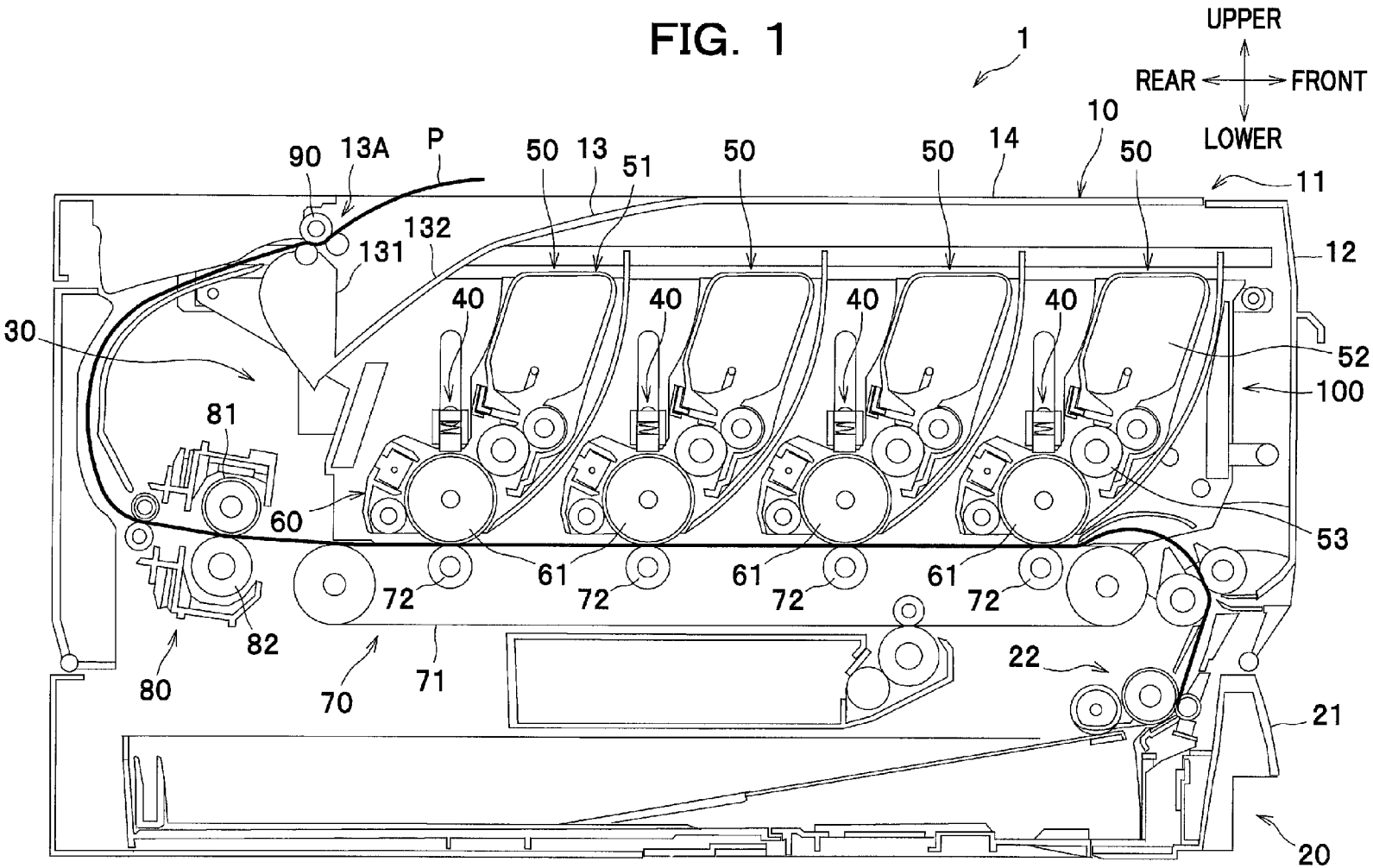
FIG. 1 is a sectional view of a color printer according to an illustrative embodiment.

A detailed description will be given of some illustrative embodiments of the present invention with reference to the drawings. In the following description, a general setup of a color printer as an example of an image forming apparatus will be described at the outset, and then features relating to the present invention will be described in detail.

Hereinbelow, the direction is designated as from the viewpoint of a user who is using (operating) the color printer. To be more specific, in FIG. 1, the right-hand side of the drawing sheet corresponds to the "front" side of the printer, the left-hand side of the drawing sheet corresponds to the "rear" side of the printer, the back side of the drawing sheet corresponds to the "right" side of the printer, and the front side of the drawing sheet corresponds to the "left" side of the printer. Similarly, the direction of a line extending from top to bottom of the drawing sheet corresponds to the "vertical" or "up/down (upper/lower or top/bottom)" direction of the printer. For clarity, hatching is provided for necessary portions only.

As shown in FIG. 1, a color printer 1 comprises a body casing 10, and several components housed within the body casing 10 which principally include a sheet feeder unit 20 configured to feed a sheet P (e.g., of paper) into the body casing 10, and an image forming unit 30 configured to form an image on the sheet P fed from the sheet feeder unit 20. The image formed in the image forming unit 30 is composed of overlaid single-color images corresponding to four colors of black (K), cyan (C), magenta (M) and yellow (Y).

In the front wall (at the front side) of the body casing 10, an opening 11 (see FIG. 3) is formed, and a front cover 12 is swingably provided at the opening 11 to openably close the opening 11. To be more specific, the front cover 12 is configured to be swingable (operable to change positions) between a closed position (position shown in FIG. 1) in which the opening 11 is closed and an open position (position shown in FIG. 3) in which the opening 11 is open.

The sheet feeder unit 20 includes a sheet feed tray 21, and a sheet conveyor system 22 configured to convey a sheet P from the sheet feed tray 21 into the image forming unit 30.

The image forming unit 30 includes four LED arrays 40 as an example of a plurality of exposure units, four process cartridges 50, a transfer unit 70 and a fixing unit 80.

Each LED array 40 is composed of a plurality of light-emitting diodes or LEDs arranged on a semiconductor chip, and configured to expose a corresponding photoconductor drum 61 to light in the main scanning direction (parallel to an axial direction of the photoconductor drum 61). Four LED arrays 40 corresponding to the four colors are configured to be in positions above and near (in proximity to) the respective same-color photoconductor drums 61, and are supported by a drawer 100 as an example of a drum supporting member, which will be described later.

The process cartridges 50 are arranged in tandem in the longitudinal (front-rear) direction. Each process cartridge 50 comprises a development cartridge 51 and a drum cartridge 60 disposed below the development cartridge 51, and is configured to be removably installed in the drawer 100.

Each development cartridge 51 includes a toner container 52 configured to store toner as an example of developer, a development roller 53 configured to supply toner stored in the toner container 52 to the photoconductor drum 61, a supply roller and a doctor blade (reference characters thereof are omitted), and other components. Four development cartridges 51 provided for the respective colors are configured to store toner of the corresponding colors, respectively, and to be in positions off to the upper front of and adjacent to the respective same-color photoconductor drums 61. Each development cartridge 51 is configured to be detachably attached to the drum cartridge 60.

Each drum cartridge 60 includes a photoconductor drum 61, a charger known in the art (reference character thereof is omitted), and other components. Four drum cartridges 60 are provided for the respective colors, and each drum cartridge 60 is configured to be detachably attached to the drawer 100.

The transfer unit 70 is disposed between the sheet feeder unit 20 and an array of the photoconductor drums 61 arranged in tandem, and includes an endless conveyor belt 71 looped around a plurality of rollers, and four transfer rollers 72. The conveyor belt 71 is disposed below and opposite to each photoconductor drum 61, and the transfer rollers 72 are disposed inside the conveyor belt 71 so that the conveyor belt 71 is held between each transfer roller 72 and the corresponding photoconductor drum 61.

The fixing unit 80 is disposed rearward of the process cartridges 50 and the transfer unit 70, and includes a heating roller 81, and a pressure roller 82 which is disposed opposite to the heating roller 81 and configured to be pressed against the heating roller 81.

In the image forming unit 30 configured as described above, first, an outer peripheral surface of each photoconductor drum 61 is uniformly charged by the corresponding charger, and is then exposed to light emitted from the corresponding LED array 40. As a result, a potential of an exposed portion is lowered, and an electrostatic latent image is formed on the photoconductor drum 61 in accordance with the image data. Thereafter, toner is supplied to the electrostatic latent image on the photoconductor drum 61 by the corresponding development roller 53, so that a toner image is carried on the photoconductor drum 61.

Next, the toner images formed on the respective photoconductor drums 61 are transferred onto a sheet P one on top of another as the sheet P fed onto the conveyor belt 71 passes through between the photoconductor drums 61 and the transfer rollers 72. The sheet P then passes through between the heating roller 81 and the pressure roller 82, and meanwhile the toner images transferred on the sheet P are thermally fixed on the sheet P.

Subsequently, the sheet P with the toner images thermally fixed thereon is ejected to the outside of the body casing 10 by a sheet output roller 90 disposed downstream relative to the fixing unit 80, and placed on a sheet output tray portion 13 formed in an upper wall 14 of the body casing 10. In this embodiment, the sheet output tray portion 13 is configured as a downwardly recessed portion disposed in the middle in the lateral direction (i.e., in a position spaced from right and left sides) of the upper wall 14 of the body casing 10. With this configuration, spaces are formed inside the body casing 10 at right and left sides of the sheet output tray portion 13 (at the both sides facing in the axial direction of the photoconductor drums 61).

To be more specific, the sheet output tray portion 13 includes a first wall 131 and a second wall 132. The first wall 131 extends from a substantially horizontal rear portion of the upper wall 14 of the body casing 10 in a downward direction perpendicular to the upper wall 14, and has an ejection port 13A for a sheet P to be ejected therethrough. The second wall 132 extends obliquely upward from a lower end of the first wall 131 toward a substantially horizontal front portion of the upper wall 14 of the body casing 10, generally in an upward-and-frontward direction, and gently curves so as to upwardly bulge as viewed in the sectional view of FIG. 1.

<Structure of Drawer 100 and Therearound>

Next, a structure of a drawer 100 and therearound will be described in detail.

Figure 2:
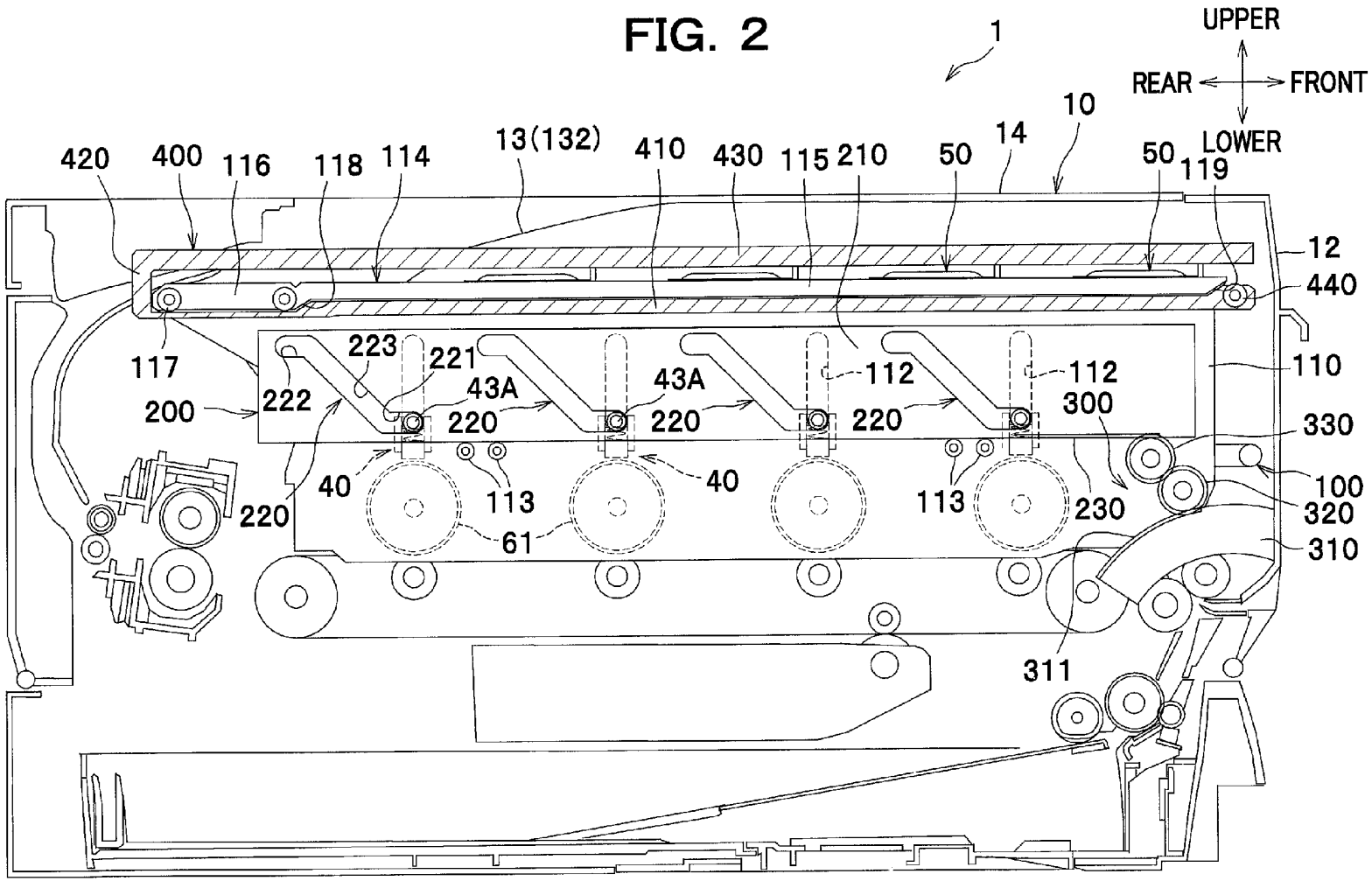
FIG. 2 is a sectional view of the color printer illustrated to show arrangements of a drawer and a translation cam, as accomplished when a front cover is in a closed position.
Figure 3:
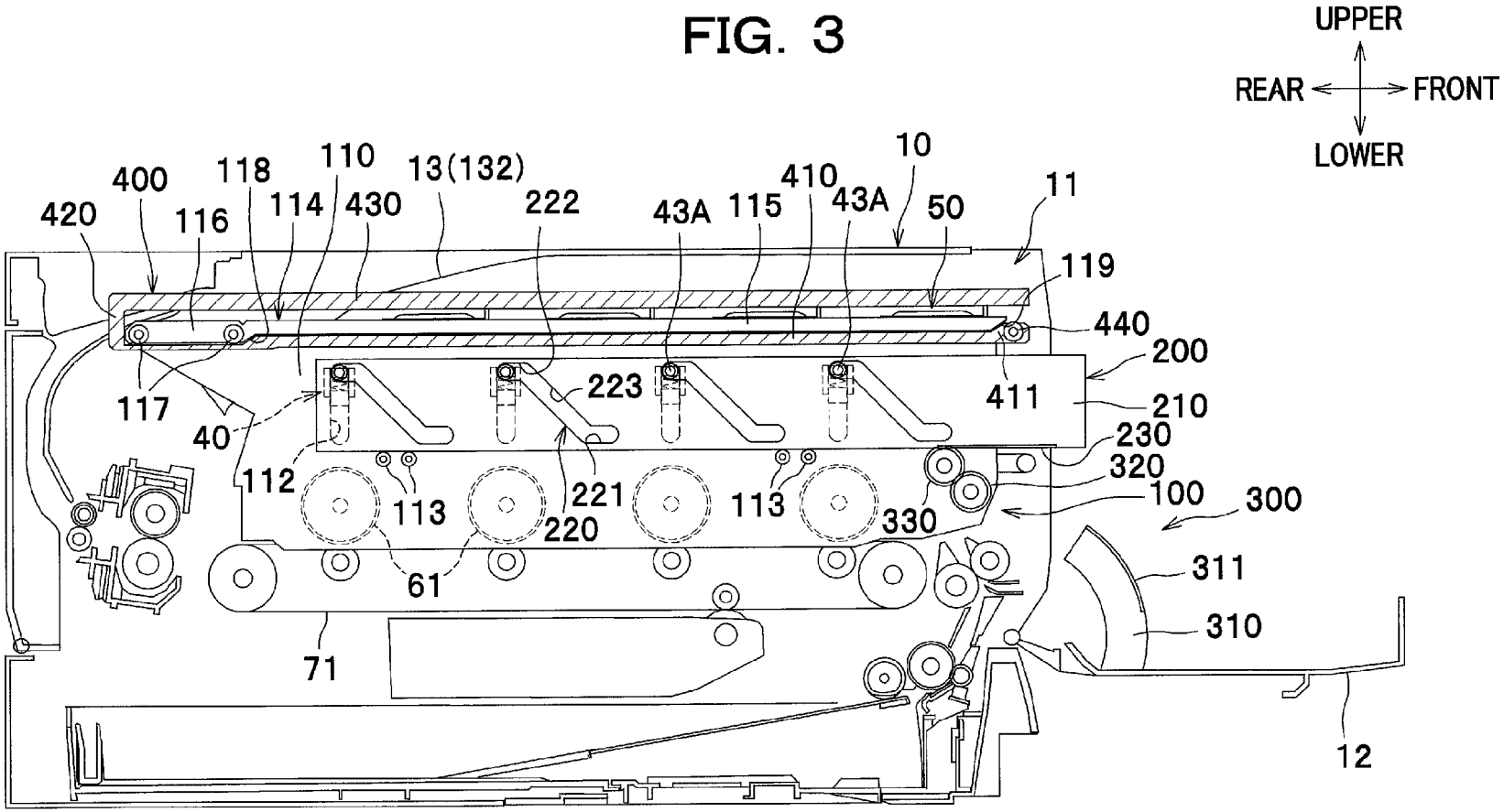
FIG. 3 is a sectional view of the color printer illustrated to show arrangements of the drawer and the translation cam, as accomplished when the front cover is an open position.
Figure 4:
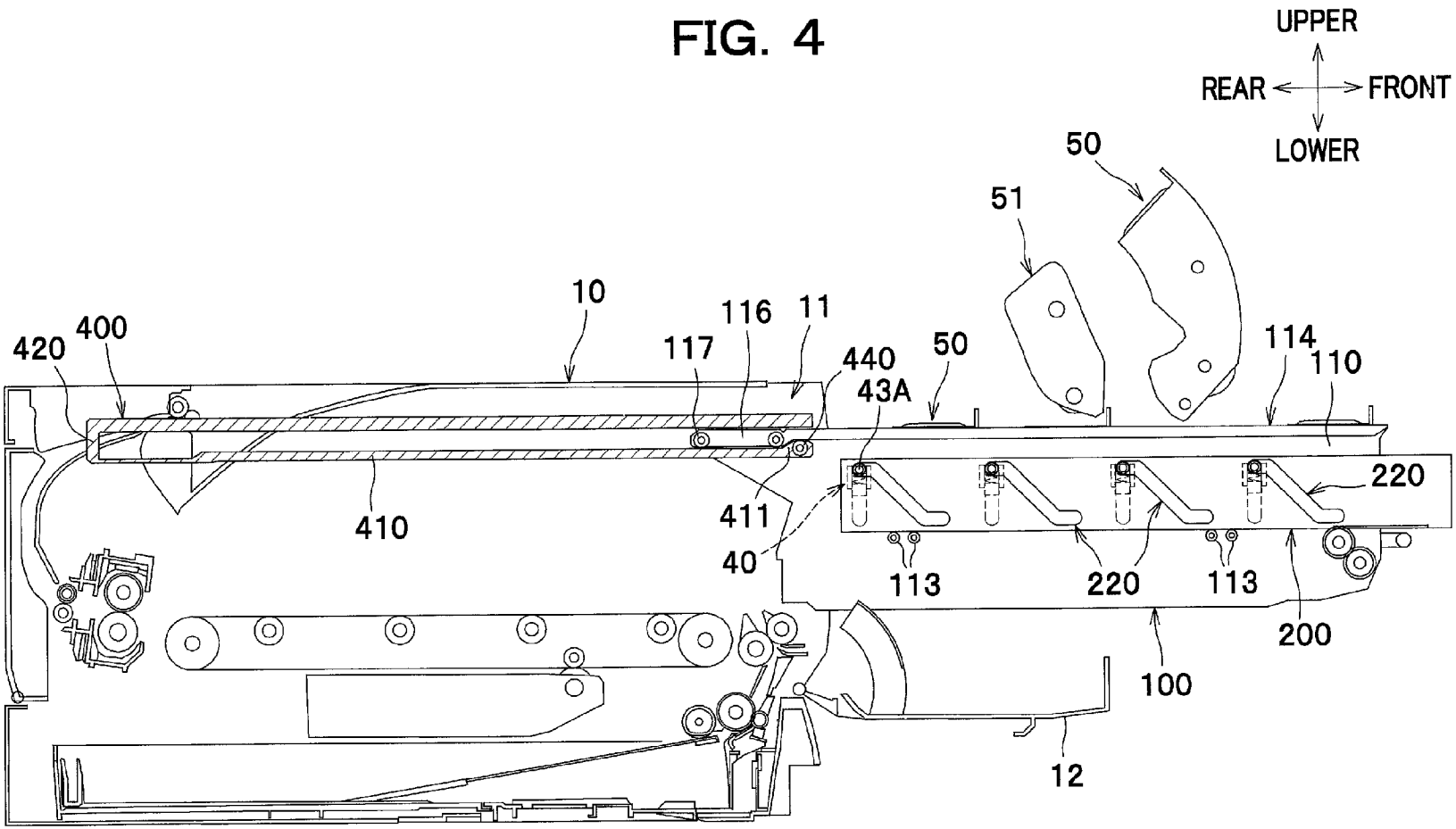
FIG. 4 is a sectional view of the color printer illustrated to show arrangements, as accomplished when the drawer is pulled out of a casing of the printer.

As shown in FIGS. 2-4, the drawer 100 is configured to be movable in the front-rear direction through the opening 11 provided in the body casing 10 between a first position (the position shown in FIG. 3) in which the drawer 100 is located inside the body casing 10 and a second position (the position shown in FIG. 4) in which the drawer 100 is located outside the body casing 10. In other words, the drawer 100 is configured to be allowed to be pulled out in a direction of the sheet P being outputted to the sheet output tray portion 13 (i.e., in the frontward direction).

Each of the LED arrays 40 disposed in the drawer 100 is configured to move up and down in synchronization with the front cover 12 being swung open and closed. To be more specific, when the front cover 12 is in a closed state, each LED array 40 is located in an exposure position (the position shown in FIG. 2) in which the LED array 40 is in proximity to the corresponding photoconductor drum 61 with a light-emitting surface thereof facing to the corresponding photoconductor drum 61; when the front cover 12 is in an open state, each LED array 40 is located in a retreating position (the position shown in FIG. 3) in which the LED array 40 retreated away from the corresponding photoconductor drum 61 is positioned by a stopper (a slot 112 which will be described later or a cam 220). The light-emitting surface of each LED array 40 is kept facing toward the corresponding photoconductor drum 61 (downward) while the LED array 40 moves upward and downward.

Each LED array 40 is configured to be located inside the drawer 100 irrespective of whether the LED array 40 is in the exposure position or in the retreating position. In other words, each LED array 40 is not permitted to protrude to the outside of the drawer 100. To be more specific, each LED array 40 is configured to move in the upward-downward direction within the drawer 100. With this configuration, each LED array 40 can be protected from the user or the like.

Figure 5:
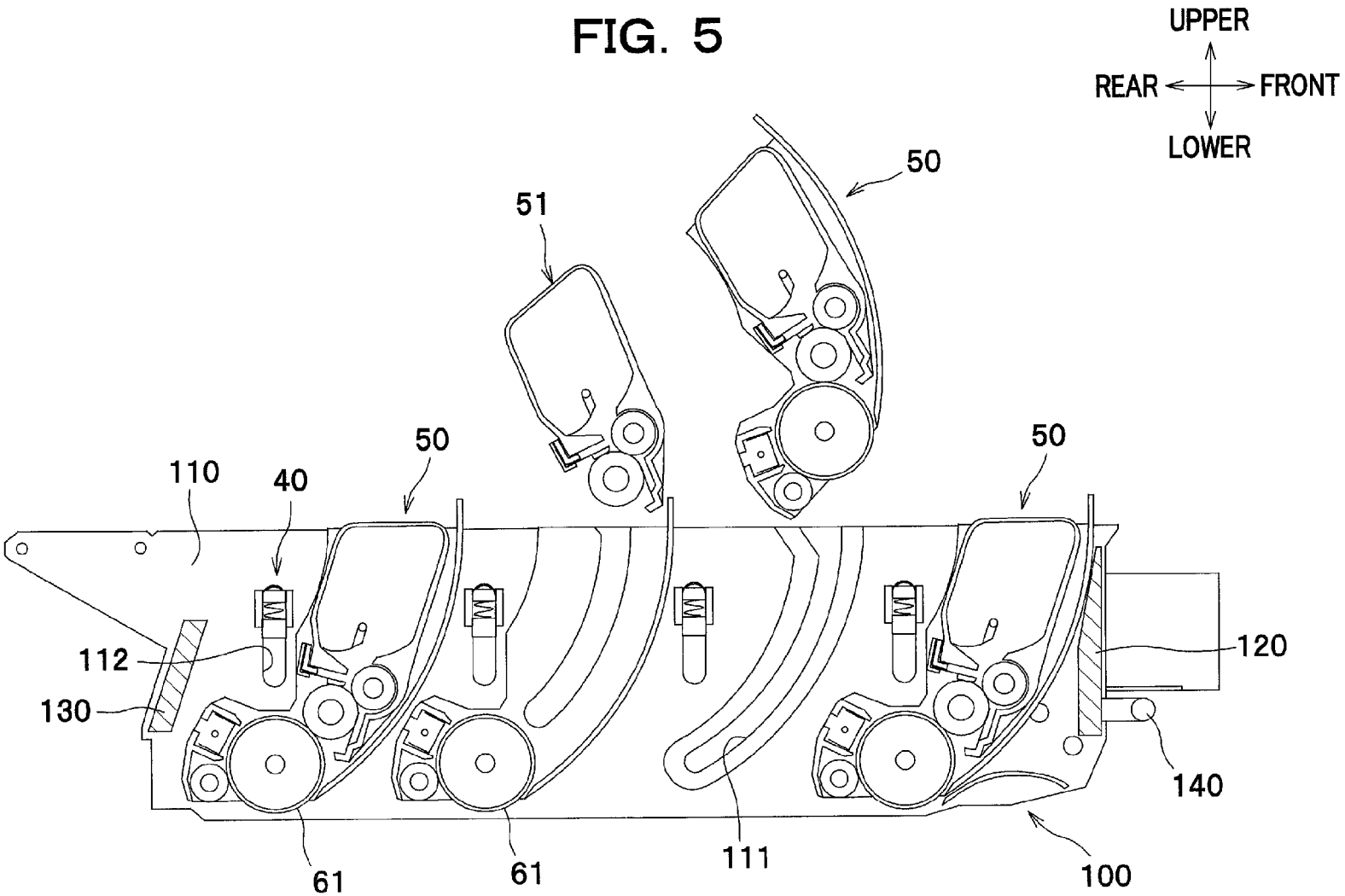
FIG. 5 is a sectional view showing relative arrangements of the drawer and process cartridges.

Specifically, the drawer 100 includes a pair of opposed sidewalls 110 located on the right side and on the left side (i.e., in positions corresponding to opposite ends in an axial direction of the plurality of photoconductor drums 61), and configured to support the plurality of process cartridge 50 (the plurality of photoconductor drums 61) and the plurality of LED arrays 40 disposed between (at insides of) the sidewalls 110. As shown in FIG. 5, the pair of sidewalls 110 are connected at their front end portions by a front wall 120 and connected at their rear portions by a rear wall 130. At a front side of the front wall 120, a handle portion 140 in the form of a letter U in cross section is provided for a user to grip to manipulate the drawer 100. More specifically, the drawer 100 is configured to have a substantially rectangular parallelepiped box in which the plurality of process cartridges 50 (the plurality of photoconductor drums 61) and the plurality of LED arrays 40 are supported. At a rear end portion of this box (at an upper portion at the rear side of each sidewall 110), substantially triangular portions is provided which protrudes rearward therefrom.

At an inside of each sidewall 110, an arc-shaped groove 111 is formed which serves to guide the corresponding process cartridge 50 being moved to an exposure-ready position (the position in which the photoconductor drum 61 included therein is ready for exposure to light emitted by the LED array 40). With this configuration, each process cartridge 50 is allowed be removably installed in the drawer 100 through an operation that causes the process cartridge 50 to move on an arcing course.

The pair of sidewalls 110 include pairs of slots 112 as an example of pass-through portions configured to support each LED array 40 in such a manner that each LED array 40 can be moved upward and downward. Each slot 112 extends in the upward-downward direction, and engages with an engageable portion 43A (see FIG. 6, details thereof will be described later) of the corresponding LED array 40 so as to guide the LED array 40 moving between the exposure position and the retreating position.

Figure 6:
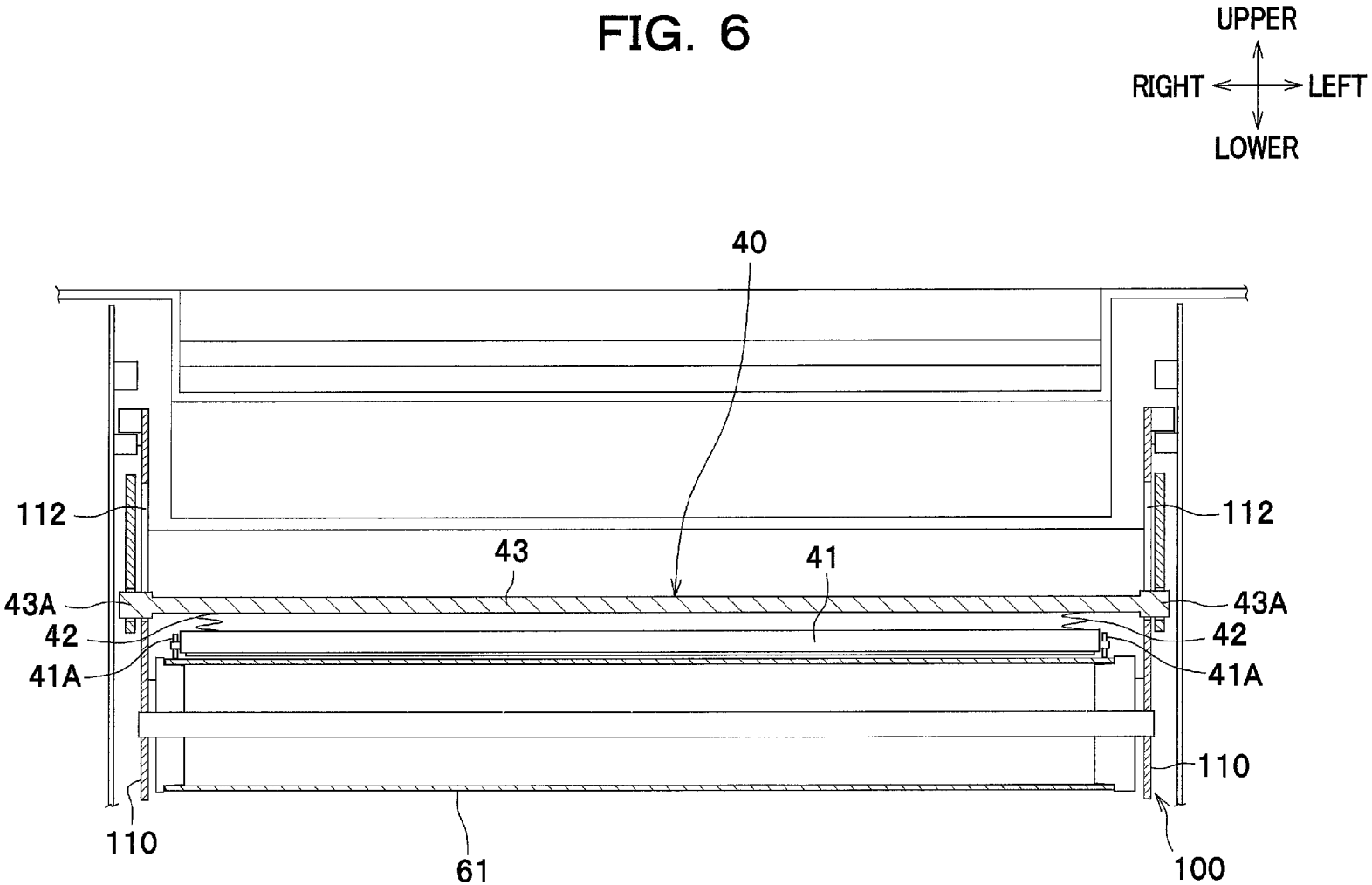
FIG. 6 is a sectional view of an LED array as viewed in the front-rear direction of the printer.

Each LED array 40 includes, as shown in FIG. 6, an LED head 41 which includes a plurality of LEDs, a pair of coil springs 42 which press the LED head 41 against the corresponding photoconductor drum 61, and a support frame 43 which supports the LED head 41 through the coil springs 42. The support frame 43 is disposed laterally with a direction of its length extending in the right-left direction. The right and left end portions of the support frame 43 form the engageable portions 43A each configured as a projection protruding through the corresponding sidewall 110 outward through the corresponding slot 112 in the right-left direction.

The engageable portions 43A protruding outward through the sidewalls 110 are, as shown in FIGS. 2-4, brought into contact with a pair of translation cams 200, as an example of a motion-imparting member, disposed outside the sidewalls 110, so that the engageable portions 43A are pressed upward and downward by the translation cam 200. To be more specific, each translation cam 200 is configured to move in the front-rear direction (i.e., the direction of movement of the drawer 100), and principally includes a plate-like main body 210 having a shape elongated in the front-rear direction, four cam holes 220 formed in the main body 210 in such a manner that the cam holes 220 are pierced in the main body 210 in the right-left direction, and a rack gear portion 230 formed at a front side of a lower end of the main body 210.

In the following description, the members disposed in pair at the right and at the left, such as the translation cams 200 and interlocking mechanisms 300 of which details will be described later, are symmetrical in structure and arrangement with respect to a median of the drawer 100 extending in the front-rear direction, and thus one of the right and left parts will be referred to as an exemplar, while the other will not be described separately for the sake of simplicity.

The main body 210 is disposed opposite to the sidewall 110 of the drawer 100, and supported in a frontwardly and rearwardly movable manner by a plurality of the support rollers 113 provided rotatably at the sidewall 110. Although not illustrated, the sidewall 110 includes a retaining member (e.g., a member having a substantially U-shaped cross section with three surfaces in abutment with an upper side, an outer side and a lower side of the main body 210) configured to retain the main body 210 in a position opposite to the sidewall 110.

Each of the cam holes 220 includes a first end portion 221, a second end portion 222 and an intermediate slanting portion 223. The first end portion 221 is a portion engageable with the engageable portion 43A of the LED array 40 located in the exposure position. The second end portion 221 is a portion engageable with the engageable portion 43A of the LED array 40 located in the retreating position. The intermediate slanting portion 223 is a portion that connects the first end portion 221 and the second connecting portion 222 to guide the engageable portion 43A moving between the exposure position and the retreating position.

The first end portion 221 of each cam hole 220 is shaped like a slot extending in the front-rear direction and arranged to have its upper edge serving to restrict upward movement of the engageable portion 43A. In this embodiment, when the LED array 40 is located in the exposure position (i.e., the position in which the LED array 40 is located when guide rollers 41A rotatably provided at the LED head 41 as shown in FIG. 6 are in contact with the photoconductor drum 61), the LED head 41 is biased downwardly by the coil springs 42 and, at the same time, the engageable portion 43A is biased upwardly by the coil springs 42. Accordingly, the engageable portion 43A of the LED array 40 is retained on the upper edge of the first end portion 221, so that the LED array 40 is positioned in the exposure position and the LED head 41 is pressed against the photoconductor drum 61 with an appropriate pressing (biasing) force.

The second end portion 222 of each cam hole 220 is shaped like a slot extending in the front-rear direction and arranged to have its upper and lower edges serving to restrict upward and downward movement of the engageable portion 43A. To be more specific, when the LED array 40 is located in the retreating position (e.g., the position in which the LED array 40 is located when the drawer 100 has been pulled out from the body casing 10), the engageable portion 43A is supported by the lower edge of the second end portion 222. Accordingly, the LED array 40 is retained at the retreating position without moving toward the exposure position. Moreover, even when a user attempts to upwardly pull out the LED array 40 in the retreating position, the LED array 40 is restricted in its movement by the engageable portion 43A being in contact with the upper edge of the second end portion 222 (or the upper end of the slot 112).

The intermediate slanting portion 223 of each cam hole 220 is shaped like a slot extending obliquely in the upward-and-rearward direction from the rear end of the first end portion 221 to the front end of the second end portion 222. With this configuration, when the translation cam 200 is moved frontward from the position shown in FIG. 2, the engageable portion 43A is pushed upward by the lower edge of the intermediate slanting portion 223 as shown in FIG. 3, and the LED array 40 is thereby moved toward the retreating position that is located at a higher position away from the corresponding photoconductor drum 61; when the translation cam 200 is moved rearward from the position shown in FIG. 3, the engageable portion 43A is pushed downward by the upper edge of the intermediate slanting portion 223 or caused to move downward under its own weight, as shown in FIG. 2, and the LED array is thereby moved toward the exposure position that is located at a lower position proximate to the corresponding photoconductor drum 61.

The rack gear portion 230 includes a plurality of gear teeth arranged in the front-rear direction, and is configured to receive a power that is produced through the open/close operation of the front cover 12 and transmitted through the interlocking mechanism 300.

The interlocking mechanism 300 is, as shown in FIGS. 2 and 3, configured to cause the translation cam 200 and the front cover 12 to move simultaneously in such a manner that the motion of the front cover 12 from the closed position to the open position causes each LED array 40 to move from the exposure position to the retreating position. To be more specific, the interlocking mechanism 300 includes an arc-shaped gear portion 310 integrally provided on the inner side of the front cover 12, a first gear 320 disposed to mesh with the arc-shaped gear portion 310, and a second gear 330 disposed to mesh with the first gear 320 and with the rack gear portion 230.

The arc-shaped gear portion 310 is in the form of a segment of a circle of which the center of curvature coincides with the center of rotation of the front cover 12. The arc-shaped gear portion 310 has a toothed portion 311 that is formed on part of the outer peripheral surface of the arc-shaped gear portion 310 and is configured to mesh with the first gear 320. The first gear 320 and the second gear 330 are rotatably mounted on each sidewall 110 of the drawer 100.

With this interlocking mechanism 300 configured as described above, in operation as shown in FIGS. 2 and 3, when the front cover 12 is opened or closed, its motion is transmitted through the arc-shaped gear portion 310, the first gear 320 and the second gear 330 to the rack gear 230, and causes the translation cam 12 to move in the front-rear direction. Accordingly, the user's simple operation of opening or closing the front cover 12 automatically causes the upward or downward movement of the LED arrays 40, and thus the ease of operation of the drawer 100 is enhanced in comparison with an alternative configuration in which the LED arrays 40 are manually moved.

At an upper end portion of each sidewall 110 of the drawer 100, a guide-engaging portion 114 protruding outward in the right-left direction is formed. The guide-engaging portion 114 is a portion movably supported by a guide member 400 provided at the body casing 10, in such a manner that the guide-engaging portion 114 can move frontward and rearward. The guide-engaging portion 114 includes an elongate portion 115 extending in the front-rear direction, a protrusion 116 integrally provided at a rear end of the elongate portion 115 and shaped to downwardly protrude to a level lower than an undersurface of the elongate portion 115, and a wheel 117 rotatably provided at the protrusion 116. A level-gap bridging surface 118 formed between an undersurface of the protrusion 116 and the undersurface of the elongate portion 115 is configured as a bevel slanting in the upward-and-frontward direction. Similarly, an under surface 119 of a front end portion of the elongate portion 115 is configured as a bevel slanting in the upward-and-frontward direction.

The guide member 400 includes a lower wall portion 410, a rear wall portion 420, an upper wall portion 430, and a wheel 440. The lower wall portion 410 is contoured to fit the shape of an undersurface of the guide-engaging portion 114. The rear wall portion 420 is configured to come in contact with a rear end of the guide-engaging portion 114. The upper wall portion 430 is configured to face an upper surface of the guide-engaging portion 114. The wheel 440 is rotatably provided at a front end portion 411 of the lower wall portion 410.

With this configuration, as shown in FIGS. 3 and 4, when the drawer 100 is pulled out from the first position inside the body casing 10 to the second position outside the body casing 10, the user's operation of pulling the drawer 100 causes the wheel 117 to run on to a stepped portion of the lower wall portion, and a front end of the guide-engaging portion 114 to run on to the wheel 440. As a result, the drawer 100 is moved obliquely in the front-and-upper direction, whereby each photoconductor drum 61 is separated from the conveyor belt 71.

Thereafter, the wheel 117 of the guide-engaging portion 114 rolls on an upper surface of the lower wall portion 410 while the elongate portion 115 of the guide-engaging portion 114 is being supported on the wheel 440, so that the drawer 100 can be pulled out straight to the front. When the protrusion 116 of the guide-engaging portion 114 comes in contact with the front end portion 411 (an upwardly protruding portion) of the lower wall portion 410, the drawer 100 stops at that position (i.e., the second position outside the body casing 10).

When the drawer 100 is brought back to the first position inside the body casing 10, the user's operation of pushing the drawer 100 causes the protrusion 116 of the guide-engaging portion 114 to be fitted into a rear-side recessed portion of the lower wall portion 410 and to come in contact with the rear wall portion 420, and the drawer 100 stops at that position (i.e., the first position inside the body casing 10).

A rear-side portion of the guide member 400 configured as described above, a rear side portion of the guide-engaging portion 114 of the drawer 100 supported by this rear-side portion of the guide member 400, and a rear-side portion of the translation cam 200 described above are all located in spaces at the right and left sides of the sheet output tray portion 13 described above. To be more specific, the rear-side portion of the guide member 400, the rear-side portion (substantially triangular portions) of the drawer 100, and the rear-side portion of the translation cam 200 are disposed to overlap the sheet output tray portion 13 as viewed in the lateral (right-left) direction, when the front cover 12 is closed to enable the printer 1 to carry out the printing operation.

More specifically, when the drawer 100 is located inside the body casing 10 (i.e., in the first position), the rear-side portions (substantially triangular portions) of the drawer 100 is disposed in a position such that the substantially triangular portions protrude from a position at or around a recess formed by the first wall 131 and the second wall 132 toward the rear (see FIG. 1). Furthermore, the plurality of process cartridges 50 are arranged in tandem from a position at or around the second wall 132 toward the front, in such a manner that the first wall 131 and the second wall 132 overlap the plurality of process cartridges 50 as viewed in the front-rear direction. With this arrangement, the plurality of process cartridges 50 would never interfere with the sloped portion (second wall 132) of the sheet output tray portion 13, and a protruded rear end portion of the drawer 100 can be accommodated by utilizing the spaced at the right and left sides of the sheet output tray portion 13. It is to be understood that the substantially triangular portions protruding rearwardly at the rear end of the drawer 100 are provided in the present embodiment for the purpose of enhanced rigidity required for the rear end portion which is disposed inside the body casing 10 when the drawer 100 is pulled out to the maximum so that the drawer 100 is supported only at this rear end portion by the body casing 10 (see FIG. 4).

Accordingly, the body casing 10 can be designed to have its upper wall 14 located at a lower position without changing the depth of the sheet output tray portion 13, so that the color printer 1 can be miniaturized in its vertical dimension. Moreover, part of the drawer 100 and other components is disposed in the spaces at the right and left sides of the sheet output tray portion 13 as described above in the present embodiment, and thus the front-side portion of the guide member 400, the upper front-side portion of the drawer 100 (and the upper portion of the process cartridges 50 arranged therein), and the upper front-side portion of the translation cam 200 are disposed in the space under the second wall 132 of the sheet output tray portion 13 and the upper wall 14. Therefore, the space under the second wall 132 of the sheet output tray 13 and the upper wall 14 can be utilized effectively.

According to the present embodiment described above, the following advantageous effects can be achieved.

Since part of the drawer 100 is disposed in such a position as to overlap the sheet output tray portion 13 as viewed in the lateral direction, the body casing 10 can be miniaturized in its vertical dimension while the sheet output tray portion 13 can be designed to have a sufficient depth as desired.

Since part of the guide member 400 and part of the translation cam 200 are disposed in the spaces at the both sides of the sheet output tray portion 13, the spaces inside the body casing 10 can be utilized efficiently.

Since the LED arrays 40 are located inside the drawer 100 regardless of whether the LED arrays 40 are in the exposure position or in the retreating position, interference of the LED arrays 40 with the other members can be prevented, and the LED arrays 40 can be protected from being unintentionally touched by a user.

Since the translation cam 200 is provided at outsides of the pair of sidewalls 110, the structure of such a motion-imparting mechanism can be simplified in comparison with an alternative configuration in which the translation cam is provided at insides of the sidewalls, and interference of the translation cam 200 with the process cartridges 50 removably installable along the arc-shaped grooves 111 can be prevented.

Since the slots 112 configured such that each engageable portion 43A protrudes through the corresponding slot 112, and each slot 112 is configured to be engageable with the corresponding engageable portion 43A to guide the corresponding LED array 40 moving between the exposure position and the retreating position are provided, the structure can be simplified in comparison with an alternative configuration in which a hole through which the engageable portion protrudes and the member for guiding the engageable portion are provided separately.

Since each pass-through portion through which the engageable portion 43A protrudes is configured as a through hole (slot 112), the rigidity of the sidewalls 110 can be enhanced in comparison with an alternative configuration in which the pass-through portion is not closed but open to contiguously extend to the end of the sidewall is formed, for example.

Since the translation cam 200 is adopted as a motion-imparting member, the structure can be simplified in comparison with an alternative configuration in which the LED arrays are moved upward and downward by means of a linkage mechanism, for example.

Since the front cover 12 and the translation cam 200 are configured to be moved simultaneously, the ease of operation of the drawer 100 can be improved.

Although an illustrative embodiment of the present invention has been described above, the present invention is not limited to the above-described embodiment. Various modifications and changes may be made to the specific structures and arrangement without departing from the scope of the present invention. In the drawings referred to in the following description, substantially the same elements may be designated by the same reference characters, and a duplicate description thereof will be omitted.

Figure 7A:
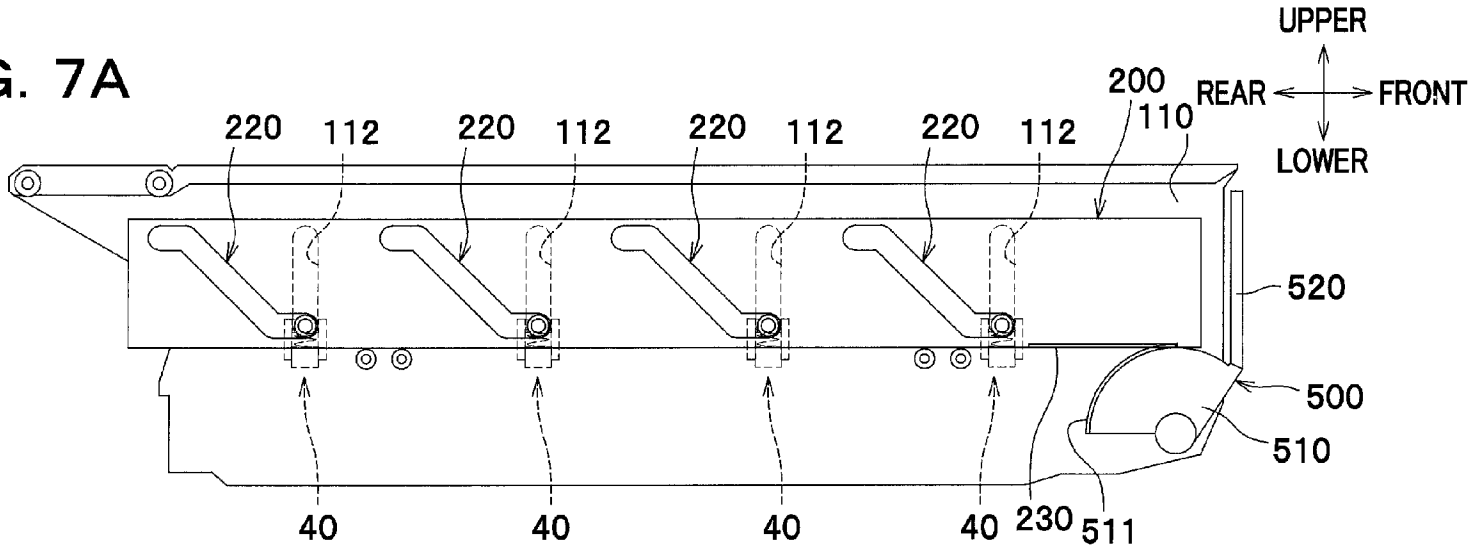
FIGS. 7A and 7B are sectional views illustrated to show an embodiment in which the translation cam is manually operated.
Figure 7B:
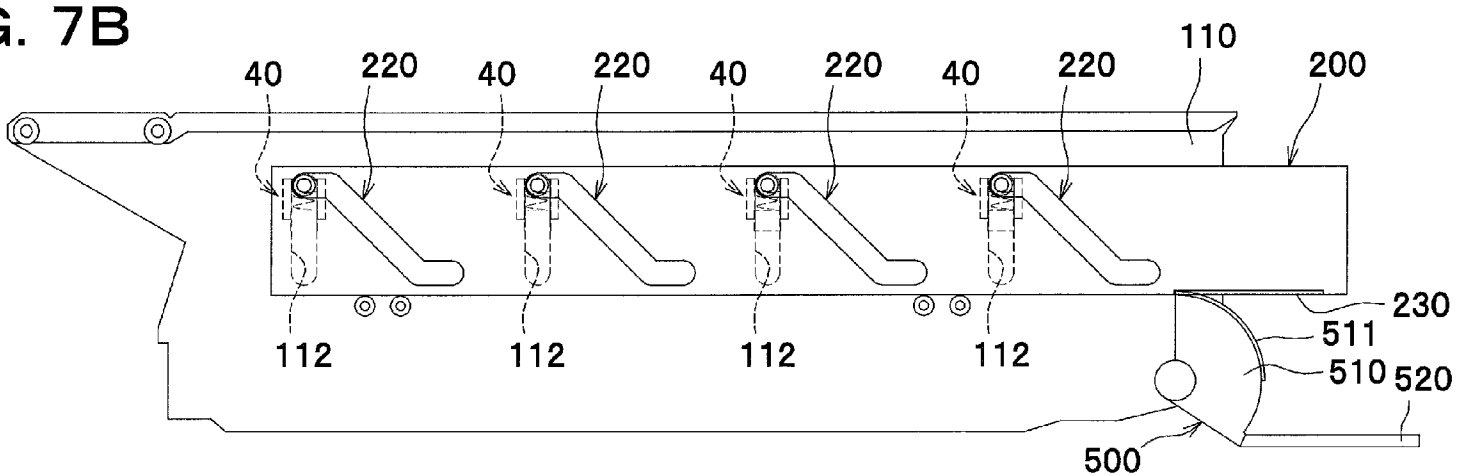

In the above-described embodiment, the translation cam 200 is interlocked with the motion of the front cover 12 being opened or closed, but the present invention is not limited to this specific configuration. The translation cam may be manually moved, instead. For example, as shown in FIGS. 7A and 7B, an operating lever 500 may be pivotally mounted to a pair of sidewalls 110 so that the translation cam 200 interlocked with the operating lever 500 can be moved through manipulation of the operating lever 500.

More specifically, in this embodiment, the operating lever 500 includes a pair of right and left sector gears 510, and an handle portion 520 shaped like a letter U and attached to connect the right and left sector gears 510. Each of the pair of right and left sector gears 510 is shaped to have a toothed gear segment of which a center of curvature coincides with the center of the pivoting motion of the operating lever 500. Toothed portions 511 of the sector gears 510 mesh with the rack gear portions 230, and thus, when the operating lever 500 is tilted down, the translation cam 200 moves frontward, to thereby cause the LED arrays 40 to move to the retreating position. On the other hand, when the operating lever 500 is raised up, the translation cam 200 moves rearward, to thereby cause the LED arrays 40 to move to the exposure position.

In the above-described embodiment, the LED arrays 40 are adopted as a plurality of exposure units, but the present invention is not limited to this specific embodiment. For example, a plurality of electroluminescence elements, fluorescent elements or other light-emitting elements arranged in an array wherein each light-emitting element is caused to selectively emit light in accordance with image data may be adopted, instead. Alternatively, a single light source and a plurality of optical shutters made of liquid crystal, PLZT or the like may be provided, in which the open/close timing of the optical shutters is selectively regulated in accordance with image data to control light from the light source.

In the above-described embodiment, the slot 112 (the upper end thereof) is used as a stopper to position the retreated exposure unit in the retreating position, but the present invention is not limited to this specific configuration; for example, another member provided separately from the sidewall may be used to position the exposure unit in the retreating position. Furthermore, the interlocking mechanism may be configured as a linkage.

In the above-described embodiment, the present invention is applied to the color printer 1, but the present invention is not limited thereto; any other image forming apparatus such as a photocopier, a multifunction peripheral and the like may be configured in accordance with one or more of the embodiments of the present invention.

In describing the embodiment, a recording sheet is exemplified by a sheet P of paper, such as a cardboard, a postcard, thin paper, and the like by way of example, but the recording sheet usable in embodiments of the present invention is not limited to that made of paper; an OHP sheet may be used, for example.

In describing the embodiment, the rear end portion of the drawer 100 shaped like a triangle protruding rearward is illustrated, but the shape of the rear end portion of the drawer 100 is not limited thereto; as long as the rear end has a protruding configuration, it may be consistent with any of embodiments of the present invention.

What is claimed is:

1. An image forming apparatus comprising:

a casing having an upper wall in which a sheet output tray portion is formed as a downwardly recessed portion to receive a recording sheet with an image formed thereon;

a plurality of photoconductor drums; and a drum supporting member having a pair of opposed sidewalls facing in an axial direction of the plurality of photoconductor drums, the drum supporting member being configured to support the plurality of photoconductor drums at insides of the sidewalls, and to be movable through an opening provided in the casing between a first position in which the drum supporting member is located inside the casing and a second position in which the drum supporting member is located outside the casing, wherein part of the drum supporting member is disposed in spaces formed inside the casing at both sides of the sheet output tray portion facing in the axial direction of the plurality of photoconductor drums, such that a portion of the sidewalls of the drum supporting member overlaps the sheet output tray portion as viewed in the axial direction.

2. The image forming apparatus according to claim 1, further comprising a guide member configured to support the drum supporting member in a manner that permits the drum supporting member to move, wherein part of the guide member and part of the drum supporting member supported by the guide member are disposed in the spaces.

3. The image forming apparatus according to claim 2, wherein the drum supporting member is movably supported by the guide member in a manner that permits the drum supporting member to be pulled out in a direction of a recording sheet being ejected onto the sheet output tray portion.

4. The image forming apparatus according to claim 1 further comprising a plurality of exposure units each configured to expose a corresponding photoconductor drum to light, to form an electrostatic latent image thereon, wherein the plurality of exposure units are provided at the drum supporting member, each exposure unit being movable between an exposure position in which the exposure unit is located in proximity to the corresponding photoconductor drum and a retreating position in which the exposure unit retreated away from the corresponding photoconductor drum is positioned by a stopper, such that the exposure unit is located inside the drum supporting member regardless of whether the exposure unit is in the exposure position or in the retreating position.

5. The image forming apparatus according to claim 4, wherein a motion-imparting member is provided at the drum supporting member, movably relative to the drum supporting member and is configured to act on an engageable portion of each exposure unit to thereby cause the exposure unit to move to the exposure position or to the retreating position, and wherein part of the motion-imparting member is disposed in said spaces.

6. The image forming apparatus according to claim 5, wherein the engageable portion of each exposure unit is configured as a pair of projections each protruding through a corresponding sidewall of the drum supporting member outwardly in the axial direction, and the motion-imparting member is provided at outsides of the pair of sidewalls.

7. The image forming apparatus according to claim 6, wherein the pair of sidewalls include pass-through portions such that the engageable portion of each exposure unit protrudes through a corresponding pass-through portion, each pass-through portion being configured to be engageable with a corresponding engageable portion of the exposure unit to guide the exposure unit moving between the exposure position and the retreating position.

8. The image forming apparatus according to claim 7, wherein each pass-through portion is configured as a through hole.

9. The image forming apparatus according to claim 5, wherein the motion-imparting member includes a translation cam configured to move along a direction of movement of the drum supporting member.

10. The image forming apparatus according to claim 5, further comprising:

a cover attached to the casing and configured to be operable to change positions between a closed position in which the opening of the casing is closed and an open position in which the opening of the casing is open; and an interlocking mechanism configured to cause the motion-imparting member and the cover to move simultaneously in such a manner that an operation of the cover from the closed position to the open position causes each exposure unit to move from the exposure position to the retreating position.

11. The image forming apparatus according to claim 1, further comprising:

a plurality of process cartridges each of which includes one of the plurality of photoconductor drums, a developer container configured to store developer, and a development roller configured to supply developer stored in the developer container to the one of the plurality of photoconductor drums included in a corresponding process cartridge, wherein each process cartridge is configured to be installable in and removable from the drum supporting member, and installation and removal of the process cartridge are performed through an operation that causes the process cartridge to move on an arcing course.

12. The image forming apparatus according to claim 1, wherein the part of the drum supporting member extends rearwardly beyond the sheet output tray portion.

13. The image forming apparatus according to claim 1, wherein the part of the drum supporting member is positioned outwardly of the sheet output tray portion.

* * * * *